United States Patent [19]

La Belle

[11] 3,942,146

[45] Mar. 2, 1976

[54] PURITY ADJUSTING DEVICE FOR SLOTTED MASK IN-LINE COLOR PICTURE TUBES

[75] Inventor: Robert La Belle, El Paso, Tex.

[73] Assignee: General Instrument Corporation, Clifton, N.J.

[22] Filed: Nov. 21, 1974

[21] Appl. No.: 525,732

[52] U.S. Cl. ..... 335/212

[51] Int. Cl.[2] ..... H01F 1/00

[58] Field of Search ..... 335/212; 313/412, 413, 313/414, 415

[56] References Cited

UNITED STATES PATENTS

| | | | |
|---|---|---|---|
| 3,512,023 | 5/1970 | Anthony | 335/212 |
| 3,605,053 | 9/1971 | Anthony | 335/212 |
| 3,858,134 | 12/1974 | Budd | 335/212 |

*Primary Examiner*—Harold Broome

[57] ABSTRACT

Apparatus is provided for performing the purity adjustment in slotted mask color picture tubes of the type having in-line electron guns located in side-by-side relationship along a single plane. The apparatus includes first and second bar magnets located externally of the tube and parallel to the gun-containing plane. Each of the bar magnets is oriented to generate a magnetic field in substantially the same plane, that plane being perpendicular to the gun-containing plane. Means are provided for jointly moving the bar magnets between a first position wherein the net resultant field generated across the gun containing plane is zero, and second position wherein the net resultant field generated by the bar magnets across the gun-containing plane is greater than zero and has a substantially equal effect on each of the guns. In a first embodiment, the moving means comprises a support upon which each of the bar magnets is fixedly mounted. Means are provided for moving the support in a plane substantially perpendicular to the gun-containing plane. In the second embodiment, each of the bar magnets is independently rotatably mounted to the support and means are provided for jointly rotating the bar magnets relative to the support. In each embodiment the movement of the magnets causes a variation in the resultant field generated along the gun-containing plane, thereby causing a correction of the misregistration of the electron beams with the phosphor dots on the tube face.

10 Claims, 7 Drawing Figures

FIG. 1
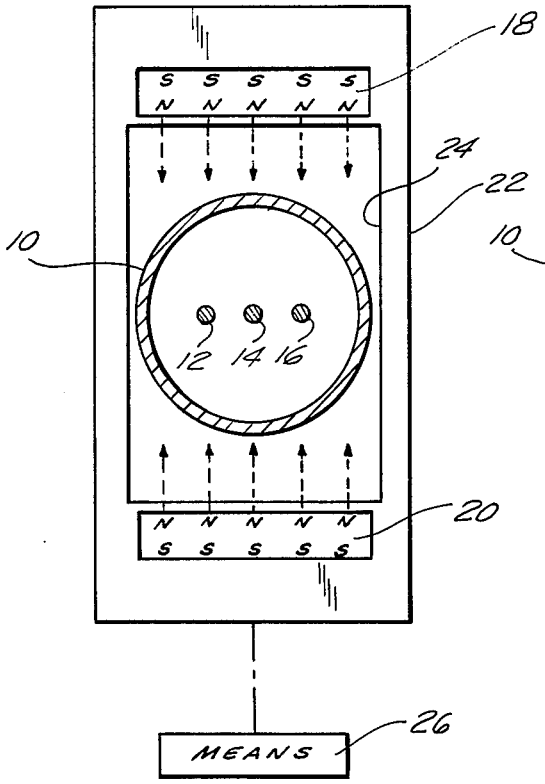
FIG. 2
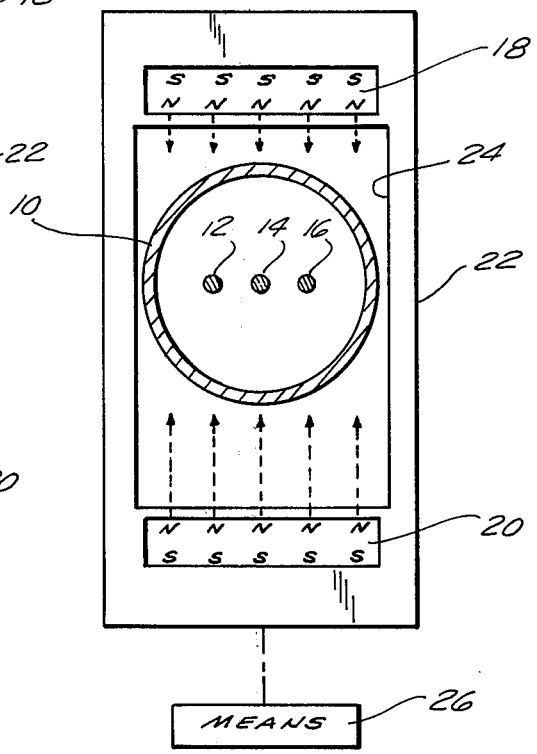
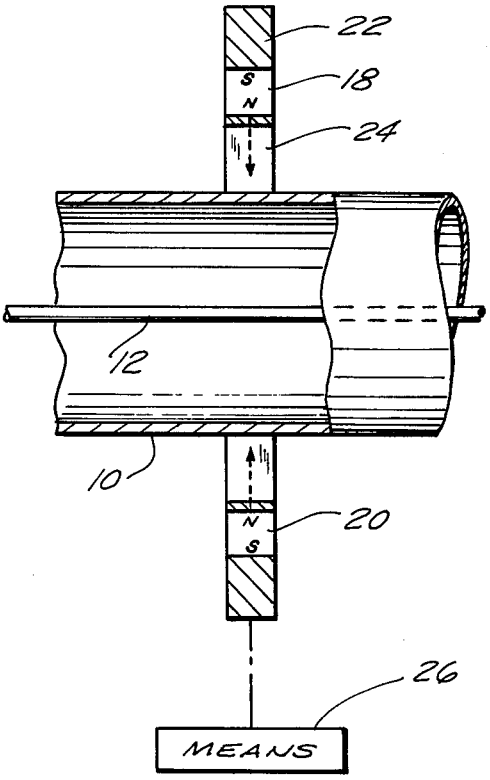
FIG. 3

FIG. 4
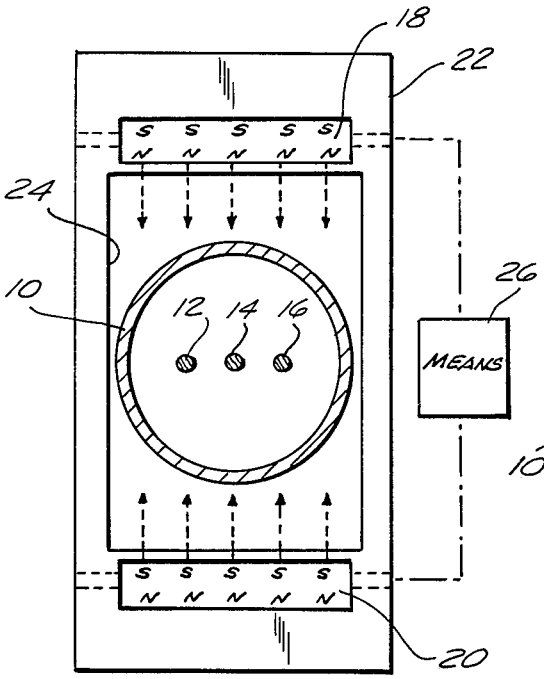
FIG. 5
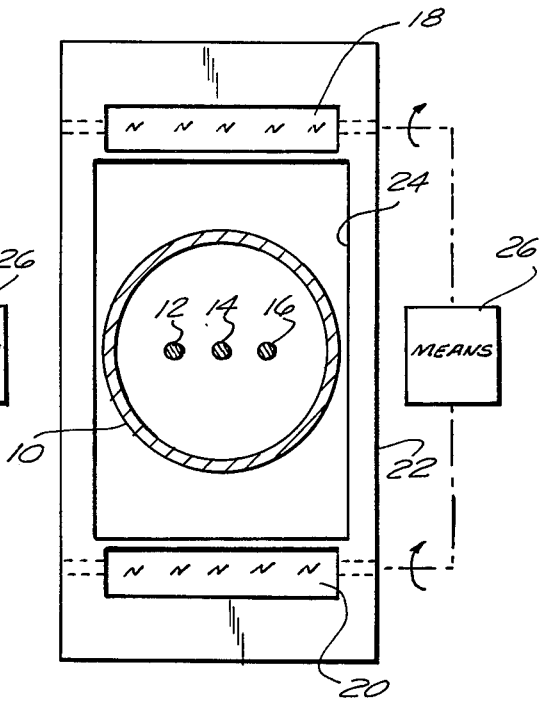
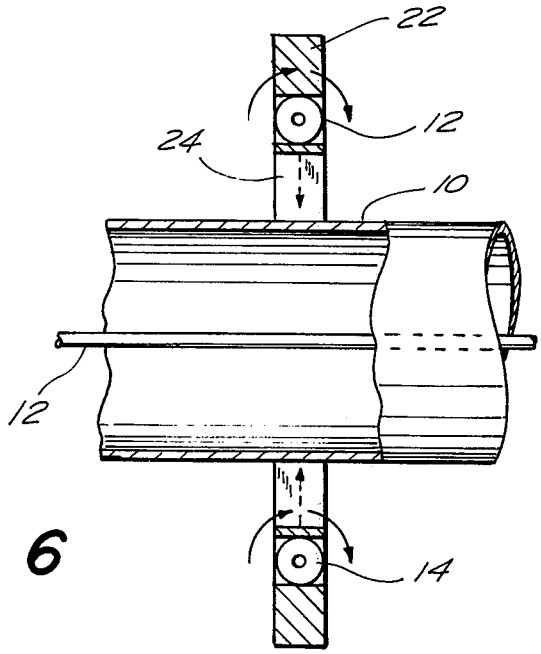
FIG. 6

PURITY ADJUSTING DEVICE FOR SLOTTED MASK IN-LINE COLOR PICTURE TUBES

The present invention relates to a purity adjusting device for use in slotted mask in-line color picture tubes, and in particular, to a simple, inexpensive device utilizing a pair of bar magnets which are jointly moved relative to the electron guns so as to correct any misregistration of the beams.

A color picture tube is produced by depositing phosphor dots of three different colors on the face of an evacuated tube. Only the dots of a single color are to be illuminated when information relating to that color is received by the television. In order to achieve this, during construction of the picture tube the phosphor is coated on the face of the tube and a shadow mask is placed over the phosphor. An ultraviolet light source is then placed in the tube at the position at which the electron gun which will be used to produce that color will be located. The ultraviolet source illuminates the phosphor, thus burning in the phosphor at the appropriate points. This process is repeated for each of the three colors, moving the ultraviolet light source each time that it is located at the position in the tube which the electron gun for that color will be located. The picture tube, when it is completed, will include an electron gun for each of the colors. Thus, three electron guns, each corresponding to one of the colors, are positioned at the respective locations in the tube where the ultraviolet light source utilized to burn in the corresponding color phosphor was originally located. In this manner, the electrons from each electron gun will illuminate only those phosphor dots on the face of the picture tube which correspond to a single color. Obviously, the electron beams must each register precisely with the appropriate phosphor dots on the tube face in order to achieve the desired picture quality. A slight misregistration of the electron beams relative to the appropriate color phosphor dots must be corrected by external magnetic means. In order to assure proper registration throughout the field, this correction must take place uniformly over the entire field of the picture tube. This change in the registration of the electron beams relative to the phosphor dots is called the purity adjustment.

At present, there are two types of color picture tubes commonly available. In one type, the electon guns are arranged in a triangular configuration with each gun at one of the verticies of the triangle. The phosphor dots on the tube face are also arrange in groups of three in the form of a triangle. This type of tube is referred to as a delta gun tube. Purity correction apparatus used in delta gun tubes consists of two carbon steel or rubber magnetic rings which circumscribe the picture tube neck. By magnetizing these rings and rotating one ring with respect to the other, a radial field is generated through the guns which is variable in strength and direction. This radial field varies the trajectory of the beams, thus correcting any misregistration of the beams with the phosphor dots on the tube.

The second type of picture tube in common use is referred to as the in-line type. In this type of tube, all three electon guns are located along a single horizontal plane. The phosphor on the face of the tube is put down in vertical strips, and the shadow mask is basically a strip mask. In order to have adequate mechanical stability, the shadow mask is actually made in the form of vertical slots which cover the entire screen. In the in-line type of picture tube, the purity adjustment must be achieved through the use of a magnetic field which is limited to a single vertical plane perpendicular to the gun-containing plane in order to affect each of the electron beams equally as well as to achieve uniform horizontal deflection of the beams throughout the field of the tube.

When the rotating magnetized ring type of purity correction apparatus, designed primarily for use in delta gun tubes, is used in conjunction with picture tubes of the in-line variety, difficulties arise because the beams will move radially and thus are not constrained to a single horizontal plane. There are, however, designs known in which the ring magnet system can provide planar deflection. This is accomplished by using a gearing system to effect opposite relative movement of each ring. This system, is, however, relatively costly and complex.

It is, therefore, a prime object of the present invention to provide apparatus for adjusting purity in a slotted mask in-line color picture tube which provides a simple and inexpensive method of purity adjustment.

It is another object of the present invention to provide apparatus for adjusting purity in slotted mask in-line color picture tubes which utilize a pair of bar magnets to provide uniform horizontal deflection of the electron beams.

It is a further object of the present invention to provide apparatus for adjusting purity in slotted mask in-line color picture tubes which utilizes a means for jointly moving the bar magnets such that the appropriate variations in the resultant magnetic field may be achieved.

In accordance with the present invention, apparatus for providing purity adjustment in slotted mask in-line color picture tubes is provided. The apparatus consists of a pair of magnets located external to the picture tube and parallel to the gun-containing plane. Each of the magnets produces a field in substantially the same plane, that plane being perpendicular to the gun-containing plane. Means are provided for jointly moving the magnets between a first position wherein the net resultant magnetic field generated across the gun-containing plane is zero, and a second position wherein the net resultant magnetic field generated across the gun-containing plane is greater than zero and has a substantially equal effect on each of the guns to assure uniform horizontal deflection of each beam.

In the first embodiment, each of the magnets is fixedly mounted to a support. Means are provided for moving the support relative to the tube, such that the net resultant magnetic field across the gun-containing plane is varied. This variation in the magnetic field causes uniform deflection of each of the beams, thereby correcting any misregistration thereof relative to the phosphor strips on the face of the picture tube.

In the second embodiment, the magnets are independently rotatably mounted on the support. Means for jointly rotating the magnets relative to the support are provided such that the net resultant magnetic field across the gun carrying plane is varied to cause uniform deflection of the beams. As in the first embodiment, the variations in the magnetic field correct any misregistration of the beams relative to the phosphor dots on the tube.

To these and other objects as may hereinafter appear, the present invention relates to apparatus for adjusting defined in the appended claims and described in the specification taken together with the drawings, wherein like numerals refer to like parts and in which:

FIG. 1 is a plan view of a first preferred embodiment of the present invention showing the support in the first position;

FIG. 2 is a view similar to FIG. 1 but showing the support in the second position;

FIG. 3 is a side partially cutaway view of the first preferred embodiment in FIG. 1;

FIG. 4 is a plan view of a second preferred embodiment of the present invention shown in the first position;

FIG. 5 is a view similar to FIG. 4 but wherein the bar magnets are in the second position; and FIG. 6 is a side partially cutaway view of the embodiment illustrated in FIG. 4.

As shown in FIG. 1, the neck of the picture tube 10, shown here in cross section, has three electron guns 12, 14, and 16 which are located in side-by-side relationship along a horizontal plane, referred to herein as the gun-containing plane. A pair of magnetic field generating means, preferably in the form of bar magnets 18 and 20, are provided externally of neck 10 and one on each side thereof. It should be appreciated that although magnets 18 and 20 are disclosed herein as having a "bar" shape, magnets of other geometrical shapes may function equally as well, with the obvious structural modifications to the remainder of the device. However, since bar magnets are readily available, the present invention has been disclosed having these types of magnets. This structure is disclosed for illustrative purposes only and should not be construed as a limitation of the present invention. Magnets 18 and 20 are positioned with respect to the gun-containing plane such that they generate magnetic fields of opposite polarity. In this instance, magnet 18 has its north pole pole directed towards the top thereof. Bar magnet 20 is oppositely oriented, having its north pole towards the top of the drawing and the south pole towards the bottom of the drawing. Preferably, each of the bar magnets 18 and 20 generate a magnetic field of equal magnitude. The magnetic fields are generated in substantially the same plane, that plane being substantially perpendicular to the gun-containing plane. In this instance, since the gun-containing plane is considered to be the horizontal, the plane of the magnetic fields will be in the vertical direction.

The first preferred embodiment of the present invention is shown in FIGS. 1, 2, and 3. Each of the bar magnets 18 and 20 are fixedly mounted to a support 22 which is preferably in the form of a frame having an opening 24 in the middle portion thereof. The neck 10 of the picture tube projects through opening 24 in support 22 such that the bar magnets 18 and 20 are situated one on either side of the neck in parallel relationship to the gun-containing plane. When both bar magnets are equidistant from the gun-containing plane, as shown in FIG. 1 and if their respective fields are oppositely oriented and equal in magnitude, a zero net resultant magnetic field results along the gun-containing plane. A zero net resultant field does not produce any deflection of the electron beams. Of course, if the magnets are of different strength, the distance of each from the gun-containing plane must be varied to achieve the zero net resultant field.

Means are provided for jointly moving the bar magnets to vary the resultant magnetic field along the gun-containing plane. This means is represented schematically by block 26 in the drawings and is operably connected to frame 22. The form of this operable connection will depend upon the particular mechanical components which go to make up means 26. It should be appreciated that the mechanical components which comprise means 26 do not, in themselves, form any portion of the present invention. Since such components may take a variety of different mechanical forms, they are not herein illustrated in any but a functional manner. However, means 26 can comprise any appropriate mechanical components, including but not limited to a gear system or a rack and pinion combination. Alternatively, a belt and pulley system may also be utilized. It should also be appreciated that support 22 will preferably be provided with the appropriate guide means within the receiver chassis such that it maintains the necessary vertical position with respect to the gun-containing plane. In addition, appropriate motion limiting means will preferably be provided in conjunction with the guide means to prevent support 22 from moving to a position wherein it may contact and break the neck 10 of the picture tube.

In order to achieve uniform horizontal deflection of the electron beams thereby correcting misregistration thereof, means 26 is utilized to move support 22 in a direction substantially perpendicular to the gun-containing plane in order to bring one or the other bar magnets 18 and 20 closer to the gun-containing plane such that the net resultant magnetic field generated along the gun-containing plane is greater than zero. Whether the beams are deflected to the right or to the left as seen in the drawings depends upon the direction of movement of support 22. FIG. 3 shows a side view of the relationship between the neck of the picture tube and support 22 with magnets 18 and 20 thereon.

It should be appreciated that by simply moving support 22 up and down in a vertical plane relative to the gun-containing plane, a net resultant magnetic field along the gun-containing plane is obtained which can be varied from a magnitude of zero to a maximum in one direction and then to a maximum in the other direction. Of course, the maximum net resultant magnetic field producible depends upon the strength of the bar magnets. Since the magnetic field is substantially planar and uniform along the gun-containing plane, the purity adjustment will take place through the entire field of the picture tube. In addition, since the field is equal in strength along the gun-containing plane, each of the electron guns 12, 14 and 16 will be effected by the field in precisely the same manner, thereby producing uniform deflection of each.

Many mechanical variations are possible in the system of the present invention. For instance, one such variation is illustrated in FIGS. 4, 5 and 6 and forms a second preferred embodiment of the present invention. In the second preferred embodiment of the present invention, the bar magnets 18 and 22 are independently rotatably mounted to support 22 such that each can be rotated about an axis substantially parallel to the gun-containing plane. In this instance, means would be utilized to move the bar magnets relative to the tube in synchronized fashion by rotating the bar magnets 18 and 22 simultanteously. The bar magnets, in the second embodiment, are oriented such that a fields generated thereby are in the same direction. Thus, when the magnets have these poles oriented in the plane perpendicular to the gun-containing plane, the fields reinforce each other (see FIG. 4) and when the poles are oriented parallel to the gun-containing plane (see FIG. 5), the fields oppose each other. Thus, net resultant field along the gun-containing plane could be varied from a maximum magnitude in one direction (as shown in FIG. 4) to a field having a zero net magnitude (as illustrated in FIG. 5) by a 90° rotation. A second 90° rotation will produce a maximum resultant field in the opposite direction. Therefore, a 180° rotation of both magnets simultaneously will provide a field which varies in intensity and polarity but is uniform in a vertical plane. This effect is substantially the same effect obtaining by the first preferred embodiment of the present invention. Again, means 26 has not been illustrated, as the mechanical components thereof are standard in the art and by themselves form no portion of the present invention. However, it should be appreciated that these mechanical components can take a variety of forms such as gears, cams, or sliders, etc.

While only two preferred embodiments of the present invention have been illustrated herein, it should be appreciated that many variations and modifications can be made thereon. Specifically, in the first embodiment, for instance, magnets of geometric shapes other than the disclosed "bar" shape may function acceptably, with the appropriate modifications to the remainder of the device. It is intended to cover all of these variations and modifications which fall within the scope of the present invention and defined by the following claims:

I claim:

1. In combination with a slotted mask cathode ray tube of the type having three electron guns located in side-by-side relationship in a plane, purity adjusting means comprising first and second magnetic field generating means, each of said means generating a magnetic field in substantially the same plane, said plane being substantially perpendicular to said gun-containing plane, and means for jointly moving said first and second magnetic field generating means between a first position wherein the net resultant field generated thereby across said gun-containing plane is zero and a second position wherein the net resultant field generated by said first and second magnetic field generating means across said gun-containing plane is greater than zero and has a substantially equal effect on each of the guns.

2. The apparatus of claim 1 wherein said first and said second magnetic field generating means are located externally of said tube and one on either side thereof.

3. The apparatus of claim 1 wherein said first and second magnetic field generating means are bar magnets.

4. The apparatus of claim 1 wherein said means for jointly moving said first and second magnetic field generating means comprises a support upon which each of said field generating means is mounted and means for moving said support relative to said gun-contaiing plane.

5. The apparatus of claim 4 wherein said support moving means moves said support in a plane substantially perpendicular to said gun-containing plane

6. The apparatus of claim 1 wherein each of said first and second magnetic field generating means generates a field of substantially equal magnitude.

7. The apparatus of claim 1 wherein each of said first and second magnetic field generating means is substantially equally spaced from said gun-containing plane in said first position.

8. The apparatus of claim 6 wherein each of said first and second field generating means is substantially equally spaced from said gun-containing plane in said first position.

9. The apparatus of claim 1 wherein said means for jointly moving said first and second magnetic field generating means comprises a support to which each of said magnetic field generating means are independently rotatably mounted and means for jointly rotating said magnetic field generating means relative to said support.

10. The apparatus of claim 9 wherein each of said magnetic field generating means are rotatable about axis parallel to said gun-containing plane and contained within a plane substantially perpendicular thereto.

* * * * *